US005793343A

United States Patent [19]

Hart et al.

[11] Patent Number: 5,793,343

[45] Date of Patent: Aug. 11, 1998

[54] DISPLAY APPARATUS FOR SIGNAGE

[75] Inventors: Stephen P. Hart; Patrick Henry Ryan, Jr., both of Atlanta, Ga.

[73] Assignee: American Signal Company, Atlanta, Ga.

[21] Appl. No.: 746,148

[22] Filed: Nov. 6, 1996

Related U.S. Application Data

[63] Continuation of Ser. No. 330,368, Oct. 27, 1994, abandoned.

[51] Int. Cl.[6] ..... G09G 3/34

[52] U.S. Cl. ..... 345/84; 345/110; 40/447; 40/449

[58] Field of Search ..... 345/55, 84, 85, 345/86, 108, 111, 110; 340/815.02, 815.53, 815.4, 815.64; 40/447, 449, 451, 492

[56] References Cited

U.S. PATENT DOCUMENTS

| | | | |
|---|---|---|---|
| 4,117,478 | 9/1978 | Skrobisch | 340/378 R |
| 4,393,362 | 7/1983 | Skrobisch | 335/272 |
| 4,425,864 | 1/1984 | Skrobisch | 116/204 |
| 4,779,082 | 10/1988 | Salam | 345/111 |
| 5,021,773 | 6/1991 | Browne | 40/447 |
| 5,022,171 | 6/1991 | Norfolk et al. | 40/447 |
| 5,050,325 | 9/1991 | Browne | 40/447 |
| 5,159,259 | 10/1992 | Hart et al. | 320/62 |
| 5,266,935 | 11/1993 | Wahlert | 345/84 |
| 5,351,065 | 9/1994 | Killinger | 345/84 |

*Primary Examiner*—Chanh Nguyen
*Attorney, Agent, or Firm*—Bernstein & Associates

[57] ABSTRACT

A portable display signage for all weather and ambient lighting conditions has dual matrices of character generating elements. One matrix is provided by a multiplicity of passive display units arranged in an array for cooperatively displaying graphics or characters. Each of the passive display elements comprises a flat disk having a reflective side and a non-reflective side. An electromagnet on each display element rotates the disk to display its reflective or non-reflective side to form an information display from the first matrix. The second matrix is formed from active display elements including light emitting diodes arranged in an array for cooperatively displaying graphics or characters. Each active display element is co-located with a passive display element to form a set and are positioned to be visible between gaps in the first matrix. A display is built from a plurality of modules containing subsets of the two matrices. Each module is based on a printed circuit board which mounts both subsets of the matrix elements and which has circuit elements controlling the matrix elements.

11 Claims, 6 Drawing Sheets

DISPLAY APPARATUS FOR SIGNAGE

"This application is a continuation of application Ser. No. 08/330,368 filed on Oct. 27, 1994, now abandoned."

FIELD OF THE INVENTION

The present invention relates generally to character graphic display apparatus for signage, and is more particularly directed to apparatus with multiple arrays of character and graphic display elements for signage.

BACKGROUND OF THE ART

Display apparatus which use matrices of rotatable disks, so called flip-disk elements, for display purposes have been described in U.S. Pat. Nos. 4,380,879 and 4,577,427. Other display apparatus have combined these flip-disks with other illumination sources such as light emitting diodes for night time viewing. A display apparatus of this type is shown in U.S. Pat. No. 5,022,171.

These display apparatus have used the one set of display elements during daytime lighting conditions, generally the flip-disks or other passive elements with light reflecting or fluorescent surfaces, and the other set during night time lighting conditions, generally the light emitting diodes or other active elements with light emitting capability. However, some of these display apparatus are configured such that when one matrix of display elements is being viewed the other can not. This leads to several disadvantageous scenarios where if ambient lighting is marginal, such as at dusk and dawn or during heavily overcast days, it is more difficult to view either of the displays. Further, for display apparatus which mask the illumination display elements with the disks of the flip-disk display elements, if the flip-disks fail, the illumination sources are hidden and the display apparatus fails both night and day.

Another problem has been the addressing of the display elements from a control to cause the information to be displayed. A typical flip-disk display contains between 800–1000 individual display elements, each needing two independent control wires. When an LED display element is added to the matrix, the number doubles to between 1600–2000 individual addressable elements, each with two independent control wires.

What is needed is a multiple element type display apparatus which can efficiently use both a passive or high ambient light display element, such as a flip-disk, simultaneously with an active or low ambient light display element, such as an LED display element. The display apparatus should be able to independently control both active and passive types of display elements in relatively high numbers with out complex circuitry or construction for addressing particular elements in the array.

SUMMARY OF THE INVENTION

A portable display signage for all weather and ambient lighting conditions has dual matrices of character and graphics display elements. One matrix is provided by a multiplicity of passive display elements arranged in a matrix for cooperatively displaying a character or characters. Each of the passive display elements comprises a flat surface having a reflective or fluorescent side and a non-reflective or non-fluorescent side. An electromagnet on each passive display unit rotates the surface to alternatively display its reflective or non-reflective side to form an information display for the first matrix. In the preferred embodiment, the passive display surface is a disk shaped surface on which one side is coated with reflective material similar to that used on reflective highway signage. It is evident that many other shapes could be used for the passive display surface and that would be are equivalents of the disk shape.

The second matrix is formed from active display elements having illumination sources, such as incandescent lamps, fluorescent lamps, light emitting diodes or the like, which are positioned to be visible between the spacing of the disk display elements of the first matrix. Each passive display element has an associated active display element, both of which can be seen at the same time, and which together form a display element set.

A display apparatus for signage is built from a plurality of modules containing a subarray of each of the two matrices of display elements. Each module is based on a printed circuit board which mounts both subarrays of the matrix elements so that they can be viewed simultaneously and which has control circuit elements independently controlling the matrix elements of the module from a common control bus. The printed circuit board not only provides a mounting platform for both subarrays but also provides circuit paths to distribute the control bus throughout the module and further mounts control circuits for controlling the states of the display elements from control signals on the bus.

In normal daytime operating conditions, the display apparatus exposes the reflective side of the disk display elements to the ambient light to display a desired message either in characters or graphics. When ambient light becomes absent, such as during nighttime hours, the illumination display elements are turned on and the disks display elements are either reset or left in their daytime configuration. During periods of uncertain lighting, such as dusk, dawn, and heavily overcast days, the two displays can be used together to complement their individual visibility.

These and other objects, features, and advantages of the present invention will become apparent upon reading the following detailed description of the preferred embodiments of the invention, particularly when taken in conjunction with the accompanying drawings and the appended claims.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

Figure 1:
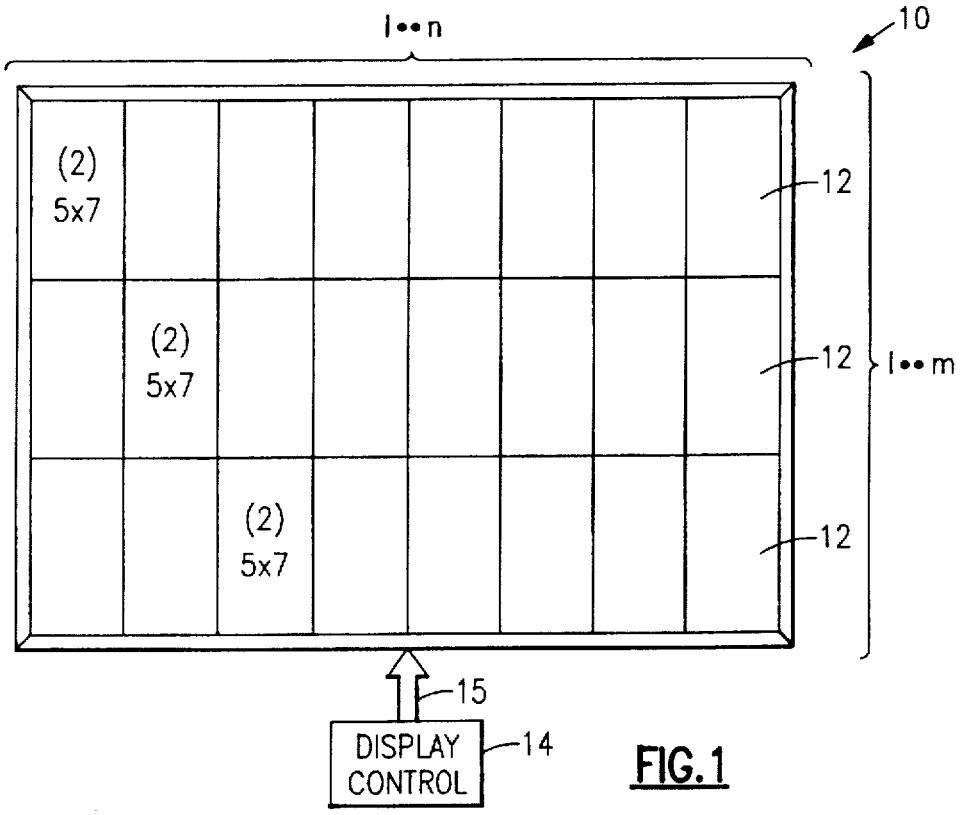
FIG. 1 is a pictorial representation of a display apparatus constructed in accordance with the invention.

With reference now to FIG. 1 there is shown a display apparatus 10 or signage constructed in accordance with the present invention. The display apparatus 10 comprises essentially an array of nxm display modules 12 mounted on a suitable support structure. In the illustrated embodiment, an 8-column, 3-row, display apparatus 10 is shown, but it is understood that the array could be of any size and number of display modules 12. As will be more fully described hereinafter, each of the display modules 12 is formed of a printed circuit board on which are mounted a plurality of display elements of two types, active and passive, forming two subarrays of display elements. Each of the display elements of each of the modules is uniquely addressable by a display control 14 which can then display characters or graphic information by selectively controlling each display element in either array to be either on or off. The display control 14 is advantageously connected to each display module through a series of individual cables 15 which allow the control to be placed in a centralized location and an environmentally protected enclosure.

The display apparatus 10 is particularly useful for outdoor stationary and portable displays or signage where different ambient lighting conditions occur. Such displays can be used in construction zones on highways, buildings, etc. for warnings or for advertisements, and other information displays of all types.

Figure 2:
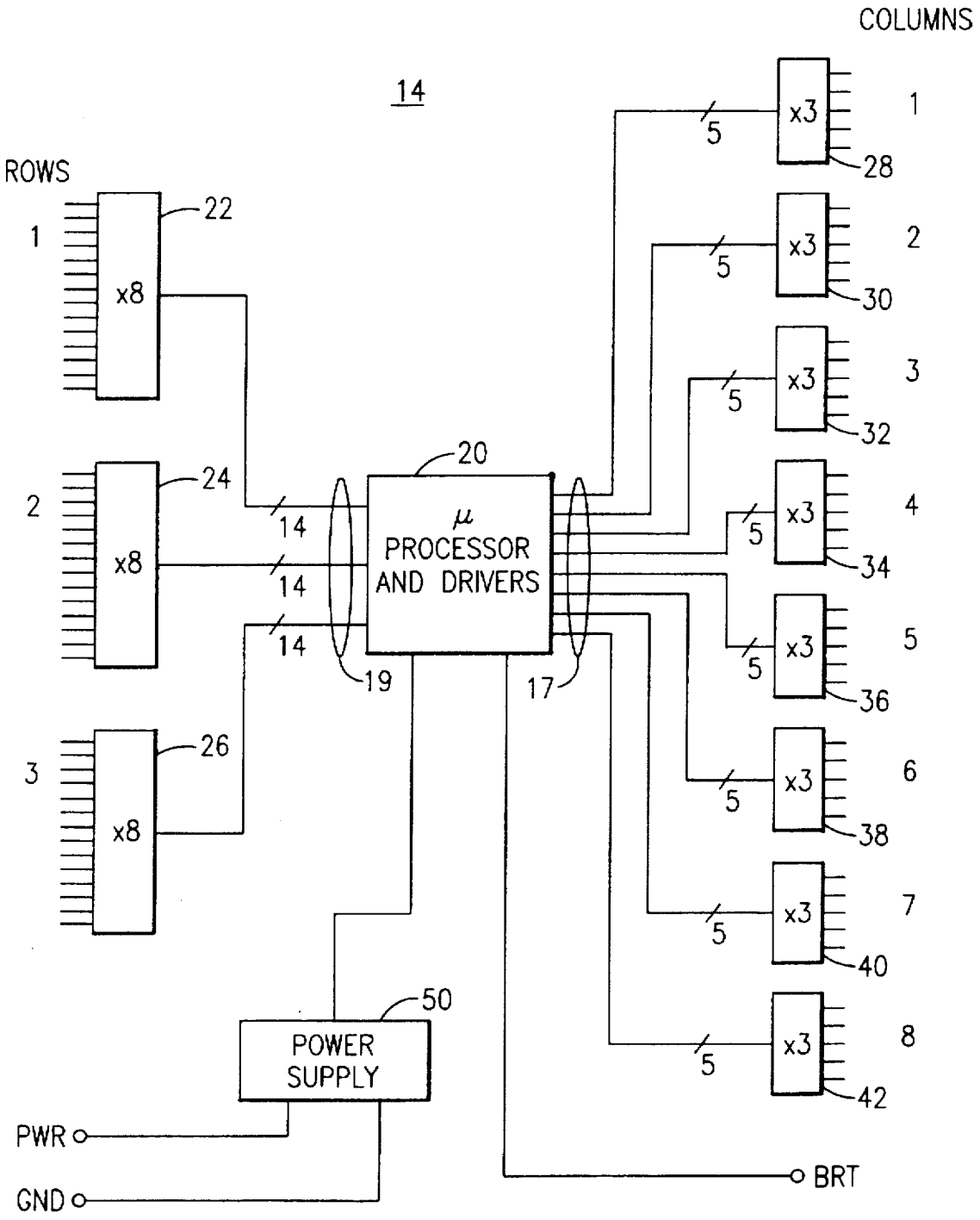
FIG. 2 is a schematic view of a module of the display apparatus illustrated in FIG. 1.

The display control 14 will now be more fully described if attention will be directed to FIG. 2 which shows a detailed electrical schematic of the device. The display control 14 is a microprocessor based controller which communicates control signals through the plurality of individual cables 15 to each of the 24 display modules 12. The control signals for each of the modules 12 are a SET, a RESET and a COMMON control signal on three respective control lines which are generated from microprocessor and driver circuits 20 and which are addressed to each of the elements in the arrays.

The microprocessor 20 is operated under the regulation of a system program which governs the functions and information display of the signage. The messages to displayed on the signage, their initiations and durations are input to the microprocessor 20 through an input device (not shown), preferably a port which is connected to personal computer or the like. The system program encodes the message and controls the individual elements of the display with the control signals to cause the display at the programmed times.

The control signals for each display element are generated from digital signals on the output ports of the microprocessor 20 and are converted into driving voltages by the driver circuits before being output to the individual display modules 12. To allow for different sizes of signage, to permit a facile modular structure for the displays and to advantageously simplify the display control 14, a multiplexing scheme for the control signals is used to control a multiplicity of display elements from a relatively small number of microprocessor ports.

The control signals are generated from a plurality of column output ports 17 and a plurality of row output ports 19. One column output port 17 is used for each column of display modules in the display signage and one row output port 19 is used for each row of display modules in the display signage. In the illustrated embodiment, this produces 8 column output ports 17 and 3 row output ports 19 which are connected to output cable connectors 22–42 on the same printed circuit board as the microprocessor and driver circuits 20.

Each column output port 17 provides five COMMON control lines for a particular set of modules 12 in one of the signage columns, each of which has an individual output connector, for example the three connectors referenced as 28 for column 1. Individual five conductor cables 15, which can be ribbon cables or the like, connect each of the three output connectors 28 to a respective input connector 18 (FIG. 3) on one of the three column 1 modules 12. Similarly, the other column output ports 17 have five COMMON control lines connected to respective output tri-connectors 30–42 for columns 2–8 of the display apparatus 10.

Each row output port 19 provides seven pairs of SET and RESET control lines for a particular set of modules 12 in one of the rows of the signage, each of which has an individual output connector, for example the eight connectors referenced as 22 for row 1. Individual fourteen conductor cables 15, which can be ribbon cable or the like, connect each of the eight output connectors 22 to a respective input connector 16 (FIG. 3) on one of the eight row 1 modules 12. Similarly, the other row output ports 19 have seven pairs of SET and RESET control lines connected to respective output octo-connectors 24 and 26 for rows 2 and 3 of the display apparatus 10.

In addition, a pulse width modulated brightness control signal BRT and power PWR and ground GND connections are coupled to all the modules 12. The power and ground connections are from a common power supply 50 which is in the same enclosure of the microprocessor and drivers 20.

Figure 3:
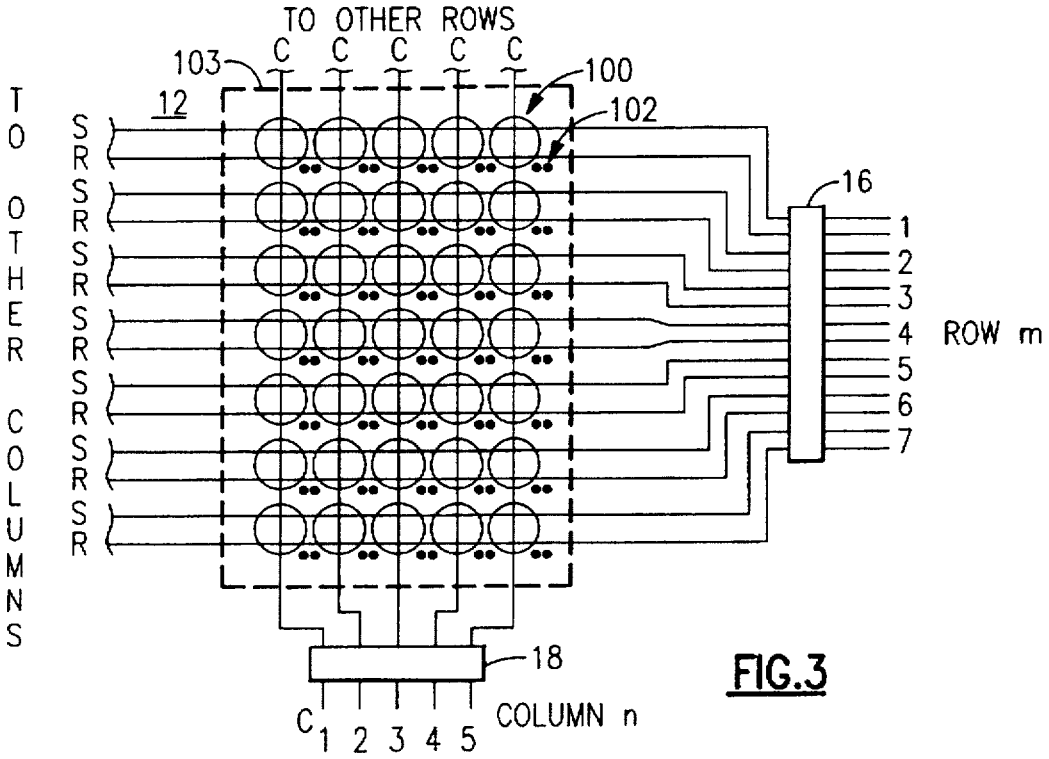
FIG. 3 is detailed schematic of the display control of the display apparatus illustrated in FIG. 1.

As is better illustrated in FIG. 3, this provides a common control and bus structure for the entire display apparatus 10 where each module 12 may addressed from the display control 14 with only a single pair of connectors 22–42 and a single pair of cables 15, one for its column position and one for its row position in the array. The printed circuit board 103 on which the display elements 100 and 102 are mounted have conductors which carry the control lines to each set of display elements in the subarray. The seven pairs of SET and RESET control lines to each input row connector 16 are commonly coupled to respective rows 1–7 of display elements of each module 12. The five COMMON control lines to each input column connector 18 are commonly coupled to respective columns 1–5 of display elements of each module 12.

Because of the paralleled output connectors 22–42 at the display control 14, this configuration produces a bus structure where all display element sets in a column of the signage matrix for all modules 12 have a shared COMMON control line and where all display element sets in a row of the signage matrix for all modules 12 have a shared pair of SET and RESET control lines. The result is that each display element set has a unique address which is a combination (intersection) of its SET, RESET and COMMON control lines which can be used to individually select that set of display elements and control them.

With this multiplexed bus structure, 24 display modules 12, each having 70 (2×5×7) individual display elements, for 1680 display elements total, can be controlled with 11 (3+8) output ports of the microprocessor. This control structure is very modular where a different sizes of signage can be made by changing the number of rows or the number of columns of display modules, reprogramming the software and changing the number of output ports and paralleled connectors to match the size. Advantageously, the display modules 12 of each different sized signage remain the same as do their two cables 15 to the input connectors 16 and 18.

Figure 4:
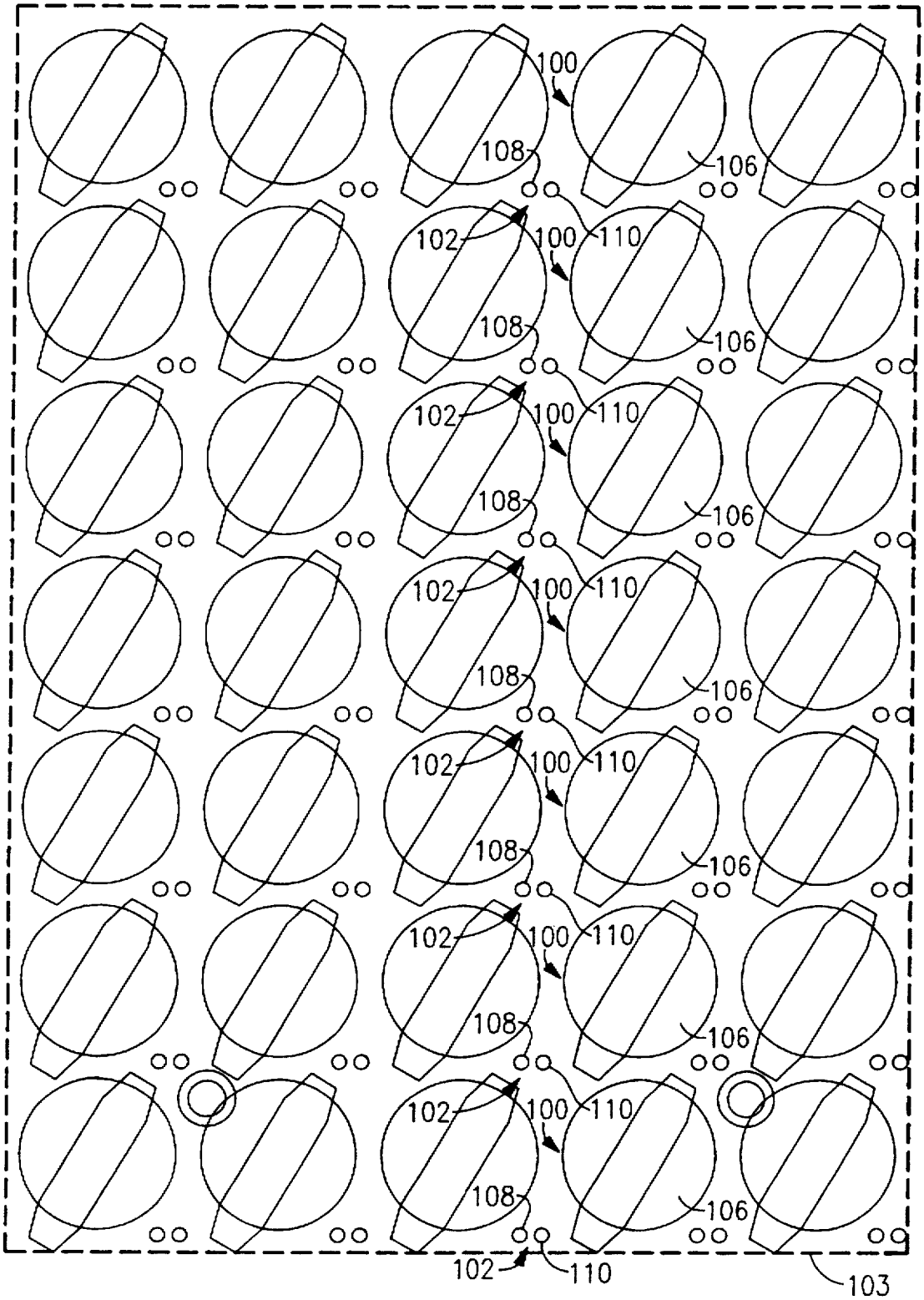
FIG. 4 is a pictorial front view of the disk display elements and illumination display elements of the module illustrated in FIG. 2.

In the preferred embodiment, as better illustrated in FIGS. 3 and 4, each display module 12 contains a first 5×7 array of passive disk display elements 100 and a second 5×7 array of active illumination display elements 102. This is convenient manufacturing size for the display module 12 and can be made with more or less display elements depending on the circumstances. One of each type of display elements, an active element and a passive element, are co-located to from a display element set at the array position intersections of the SET, RESET, and COMMON control lines.

The disk display elements 100 include disk shaped display components which can be rotated to display a reflective or fluorescent side (on) or a non-reflective or non-fluorescent side (off) while the illumination display elements 102 are formed of clusters, i.e. one or more, light emitting diodes (LEDs) 108, 110.

Figure 6:
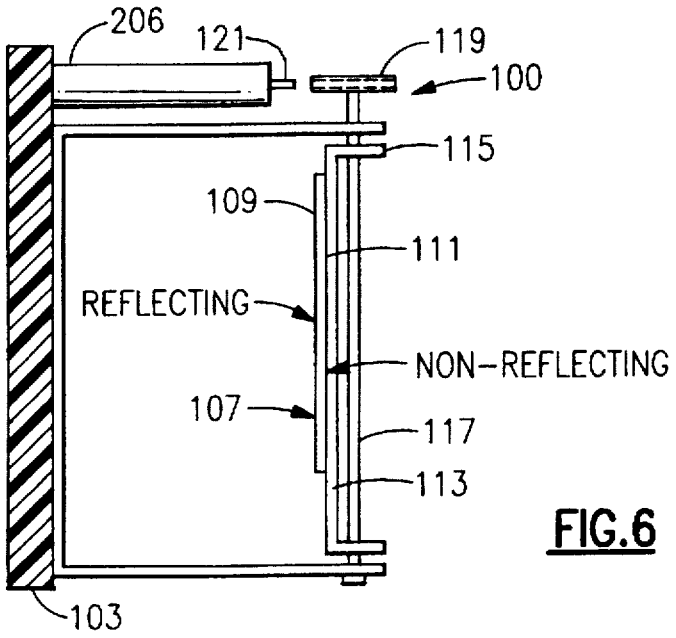
FIG. 6 is a partially broken side view of the set of display elements illustrated in FIG. 5.
Figure 5:
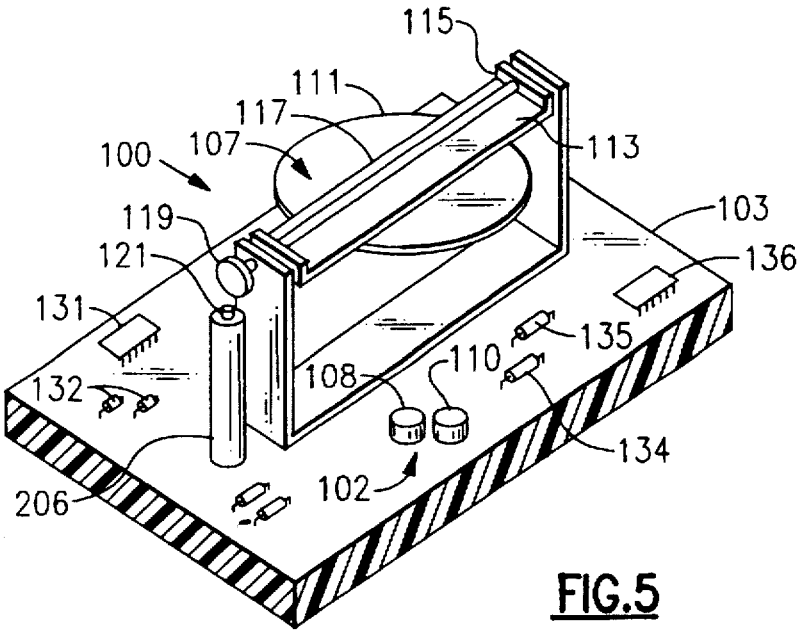
FIG. 5 is a partially broken perspective view of the of one the sets of display elements of the module illustrated in FIG. 4.

Referring now to FIGS. 5 and 6, each display element set has a disk display element 100, an illumination display element 102, a control intersection, and activation and control circuitry for the display elements. The activation and control circuitry decodes pulses from the control lines for each set of display elements and controls their states. Advantageously, the circuitry is formed from circuit components 131–136 which can be mounted in proximity to the display element set on the printed circuit board 103.

The disk display element 100 has a disk 107 with a colored light reflective side 109 and a black or non-reflective side 111 which can be rotated approximately 180 degrees to one of two positions so that either the colored side faces outwardly and is exposed to ambient light or the nonreflective side faces outwardly when the position is reversed. The disk 107 of the disk display unit 100 is rotatably supported by a rectangular U-shaped bracket 113 secured to the disk on its non-reflective side 111. The bracket 113 has a pair of arms 115 apertured at their ends to journal a rotatable shaft 117 which is secured to the spaced leaves at opposite ends of the bracket 113. One outer end of the shaft 117 carries a permanent magnet 119 having diametrically spaced N-S poles. The magnet 119 rotates substantially 180 degrees adjacent a pole piece 121 of electromagnet 206 mounted on the printed circuit board 103.

The illumination display elements 102 comprises two LEDs 108 and 110 clustered to radiate outwardly in a cone of light which does not interfere with, and is not interfered with, the disk display element 100. The LEDs 108 and 110 are mounted on the printed circuit board 103 and are connected to the associated control circuit by conductors etched on the board. The cluster of LEDs 108 and 110 is located in the generally diamond shaped area between the edges of the circular disks 106 to provide side by side associated array elements. The angle of radiation of the illumination cone is generally designed to radiate most of its power through the openings between the disk display elements 100 thereby producing two displays which can be operated simultaneously but do not interfere with the field of view of the other. The radiation cone is approximately 17–30 degrees, and, more preferable 17–22 degrees. It is to be understood that the radiation cone can be designed to be larger or smaller depending on the size and spacing of the disk elements 100 and the distance between the disk elements 100 and the LED 108. Moreover, the LEDs 108 and 110 can alternatively be other light sources, such as but not limited to, incandescent, fluorescent, fiber optic and laser light sources.

The invention provides for independent control of each subarray, and therefore, each array, to allow the array of disk display elements to be viewed simultaneously with the array of illumination display elements. In typical use manner, the disk display elements would be used during the day when they are quite visible and the illumination display elements would be used during the night when they are quite visible. During times of uneven or changing ambient lighting, for example dusk, dawn, overcast days, etc. the arrays can be used together to provide as much visibility for the message as possible from both arrays.

Figure 7:
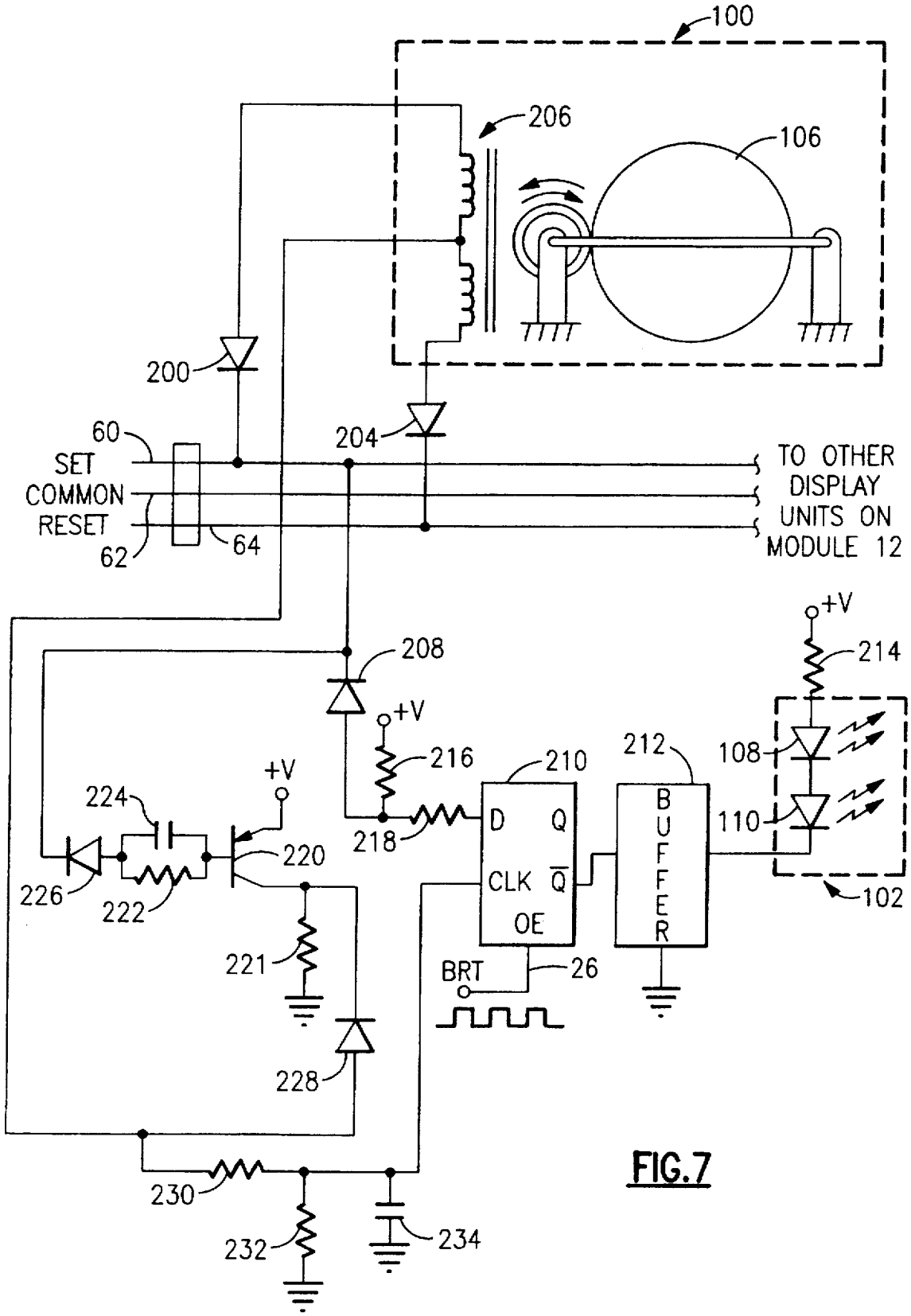
FIG. 7 is detailed schematic diagram of the control circuitry for one of the sets of display elements shown in FIG. 4.

FIG. 7 is a detailed schematic of the control circuit for each set of co-located associated display elements 100 and 102. Each set of display elements 100, 102 for each module 12 is coupled to the display control 14 through multiplexing by the three control lines 60, 62 and 64 carrying a SET signal, a COMMON signal, and a RESET signal, respectively. From these three control lines, the display elements are independently turned off and on as determined by the control program of the display control 14 to display the character and graphic information desired. Element 100 can be off while element 102 is on and vice-versa. Both can be off, or both can be on, depending upon the addressing and control program which feeds the signals to the control lines 60, 62, and 64.

The disk display element 100 is coupled at one of the coils of its electromagnet 206 to the SET control line 60 through diode 200 and is coupled at the other coil of the electromagnet to the RESET control line 64 through diode 204. The coils of the electromagnet 206 are oppositely wound and their junction is coupled to the COMMON control line 62. Control of the disk display unit 100 is accomplished via the display controller 14 by pulling the either the SET control line 60 or the RESET control line 64 to ground and pulsing the COMMON control line 62 with a +28 V., 1.5 millisecond pulse. A pulse from the COMMON control line 62, when the SET control line 60 is grounded, causes a first polarity current to flow through diode 200 and the one coil of the electromagnet 206 thereby flipping the disk 106 into position with its reflecting side up. A pulse from the COMMON control line 62, when the RESET control line 64 is grounded, causes a second polarity current to flow in the opposite direction through the other coil and diode 204 thereby flipping the disk 106 to display its non-reflecting side.

These control lines 60, 62, and 64 are also used to regulate the state of the illumination display element 102. The illumination display element 102 is controlled in either an on or off state by controlling the state of a synchronous D-type bistable 210 which has its inverted Q output connected to the input of a buffer 212. The buffer 212 inverts the state of the bistable 210 and causes the cathode of LED 110 to either be grounded or floating. The LED 110 is series connected with LED 108 to the power supply voltage +V through a current limiting resistor 214. When the inverted Q output of bistable 210 is a high logic level state, then the buffer 212 grounds the cathode of the LED 110 and the LED pair pulls current from the power supply and radiates to provide illumination for the display element 103. Conversely, when the inverted Q output state is a logical zero, the cathode of LED 110 is left floating and the LEDS 108 and 110 are turned off. The brightness of the LEDs is controlled by a brightness signal BRT which has a variable duty cycle as regulated by the display control 13. The signal BRT is used as a control signal to the tristate output terminal OE of the bistable 210 thereby producing a variable duty cycle and varying average ciurrent to the LEDs from the power source +V.

The data input D of the bistable 210 is coupled to the SET control line 60 through a diode 208 and a voltage divider including resistors 216 and 218, resistor 216 providing pullup current from the power supply voltage +V for the data input D. The clock input CLK of the bistable 210 is coupled to the COMMON control line 62 through a voltage divider including resistors 230 and 232 with a shaping capacitor 234. A clock signal inhibit circuit comprising PNP transistor 220, a filter comprising resistor 224 and capacitor 222, and diode 226 are used to inhibit the pulse signal on the COMMON control line 62 form reaching the CLK input of the bistable 210 when this particular set of display elements is not addressed. The collector-emitter junction of the PNP transistor 220 is connected between the power supply voltage +V and an collector resistor 221.

Figure 8A:
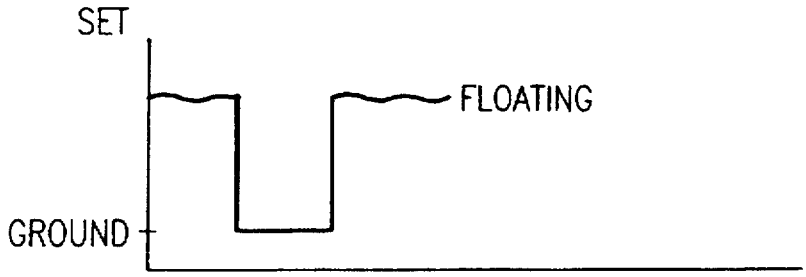
FIG. 8 is a detailed waveform and timing diagram of the SET, RESET, and COMMON control signals used for controlling the sets of display elements shown in FIG. 4.
Figure 8B:
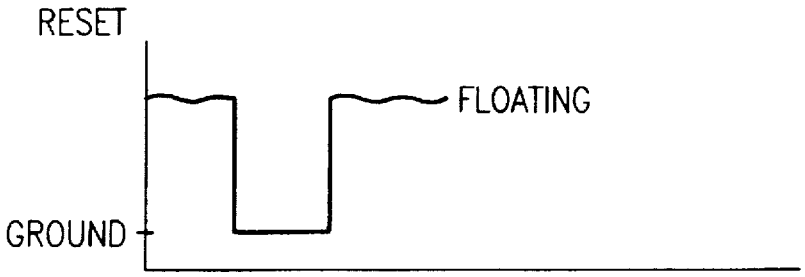
Figure 8C:
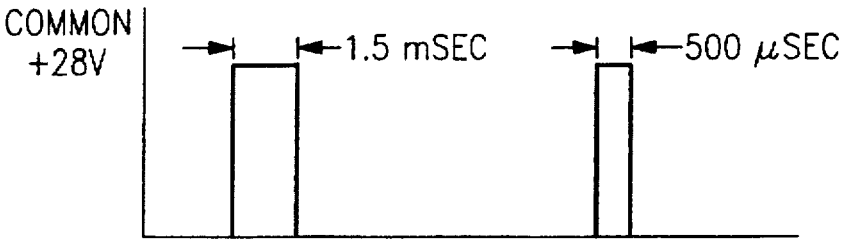
Figure 8D:
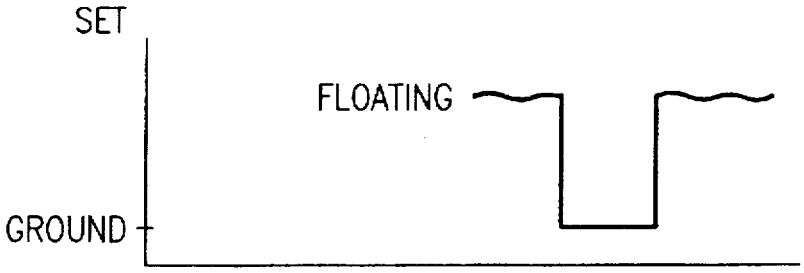
Figure 8E:
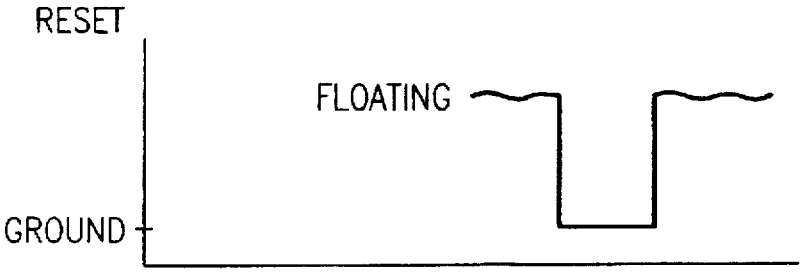

The independent control of the two different types of display elements will now be more fully explained with reference to FIGS. 7 and 8. Normally, the display will be used in the day and night mode where the disk display elements 100 will be on and the illumination display elements will be off, or vice versa. For the day time example, the disk display element 100 is turned on and the illumination source display element 102 should be turned off. As discussed previously for the control of the disk display element 100, the waveforms in FIGS. 8*a–c* are used to control this function. A COMMON signal pulse with the SET control line grounded will flip the disk element to its reflecting side and conversely, by presenting a ground (zero) to the data input D along with the a clock pulse form the COMMON control line 62 will produce a reset of the bistable 210 and turn off the illumination display element 102. A COMMON signal pulse on control lien 62, with the RESET control line 64 grounded will cause the disk 106 to flip to its non-reflective side while providing a clock signal to the bistable input CLK via the COMMON signal. This clock signal will cause a high logic level on the D input to set the bistable 210.

For an independent control of the illumination display element 102 from the disk display element 100, waveforms 8*a, d,* and *e* are used. These waveforms have the same effect on the illumination display element 102 that was discussed previously. However, because they are only approximately a third of the time period of those waveforms, 500 microseconds instead of 1.5 milliseconds, they do not overcome the hysteresis in the disk display element 100 and do not affect the state of the element.

In an alternative embodiment the illumination display element 102 can be dimmed by addition of a separate dim line (not shown) connected to each panel and all the LED enables in parallel.

While the invention has been described in connection with certain preferred embodiments, this specification is not intended to limit the scope of the invention to the particular forms set forth, but, on the contrary, it is intended to cover any such alternatives, modifications, and equivalents as may be included within the spirit and scope of the invention as defied by the appended claims.

What is claimed is:

1. A display assembly for displaying characters or graphics by an array of display units in varying ambient light conditions, comprising:

a printed circuit board having connections for a first set of display units and a second set of display units;

said first set of display units connectively disposed on said printed circuit board in a first array for cooperatively displaying characters or graphics, said first display units including a completely circular disk with a reflecting side and non-reflecting side and means for rotating the disks about an axis so as to display one side or thre other;

said second set of display units spaced from said first units, said second set of display units connectively disposed on said printed circuit board in a second array for cooperatively displaying characters or graphics, said second display units including an illumation source;

said first array and said second array being arranged such that both are viewed simultaneously;

means for controlling said first and second array;

said first set of display units is arranged in a generally rectangular matrix which includes generally diamond shaped spaces between the array display units where the edges of adjacent display disks meet;

said second set of display units is arranged in a generally rectangular matrix overlapping said first matrix and having units located in said diamond shaped areas;

thereby each of said first display units is associated with one of said second display units to form overlapping arrays wherein both associated display units can be operated simultaneously while not affecting the field of view of the other.

2. A display assembly as set forth in claim 1, wherein said illumination source is one or more light emtting diodes.

3. A display assembly as set forth in claim 2, wherein said illumination source is a light source selected from the group consisting of incandescent, fluorescent, fiber optic and laser light sources.

4. A display assembly as set forth in claim 3, wherein said illumination source is one or more incandescent lamps.

5. A display assembly as set forth in claim 4, wherein said illumination source is focused to concentrate its radiation in an outwardly directed radiation cone of approximately 17–30 degrees.

6. A display assembly as set forth in claim 5, wherein said illumination source is focused to concentrate its radiation in an outwardly directed radiation cone of approximately 17–22 degrees.

7. A display assemnbly as set forth in claim 6, wherein the angle subtended by said radiation cone of the illumination source does not substantially overlap the edges of the adjacent disks of the display units of said generally diamond shaped area.

8. A display assembly as set forth in claim 7, wherein said means for controlling includes means, co-located on said printed circuit board with each of said associated display element pairs, for independently addressing and controlling each pair.

9. A display assembly as set forth in claim 8, wherein said means for controlling includes a control bus located on said circuit board communicating with a centralized display control to deliver addressed pulses to each associated display element pair.

10. A display assembly as set forth in claim 9, wherein said means for controlling further includes an activation circuit co-located with each associated display element pair to decode said addressed pulses to the pair.

11. A display assembly as set forth in claim 10, wherein said activation circuit further includes means for decoding ihe polarity of said addressed pulses to control whether the display element pair is off or on; and means for decoding the duration of said addressed pulses to control which of the display units of the pair are controlled.

* * * * *